US011274799B2

(12) United States Patent
Goh

(10) Patent No.: US 11,274,799 B2
(45) Date of Patent: Mar. 15, 2022

(54) ELECTRONIC REMOTE CANDLE SYSTEM

(71) Applicant: Chien Ming Goh, Muttontown, NY (US)

(72) Inventor: Chien Ming Goh, Muttontown, NY (US)

( * ) Notice: Subject to any disclaimer, the term of this patent is extended or adjusted under 35 U.S.C. 154(b) by 0 days.

(21) Appl. No.: 17/393,541

(22) Filed: Aug. 4, 2021

(65) Prior Publication Data

US 2022/0042662 A1 Feb. 10, 2022

Related U.S. Application Data

(60) Provisional application No. 63/060,806, filed on Aug. 4, 2020.

(51) Int. Cl.

| | |
|---|---|
| ***F21S 6/00*** | (2006.01) |
| ***F21V 23/04*** | (2006.01) |
| ***F21Y 115/10*** | (2016.01) |
| ***F21W 121/00*** | (2006.01) |

(52) U.S. Cl.

CPC ..... *F21S 6/001* (2013.01); *F21V 23/045* (2013.01); *F21W 2121/002* (2013.01); *F21Y 2115/10* (2016.08)

(58) Field of Classification Search

CPC ..... F21W 2121/002; F21S 6/001

See application file for complete search history.

(56) References Cited

U.S. PATENT DOCUMENTS

| | | | | |
|---|---|---|---|---|
| 5,582,478 | A * | 12/1996 | Ambrosino | F21S 6/001 362/234 |
| 7,637,794 | B2 * | 12/2009 | Barri | A63H 5/00 446/175 |
| 7,922,558 | B2 * | 4/2011 | Huang | A63H 33/22 446/485 |
| 9,689,538 | B2 * | 6/2017 | Hau | H02J 50/10 |
| 10,111,307 | B2 * | 10/2018 | Li | H05B 47/19 |
| 2018/0033358 | A1 * | 2/2018 | Patton | G09G 3/3225 |

* cited by examiner

*Primary Examiner* — Alexander K Garlen
*Assistant Examiner* — Eric T Eide
(74) *Attorney, Agent, or Firm* — Collard & Roe, P.C.

(57) ABSTRACT

There is disclosed a remote-control candle kit comprising a housing a candle disposed in the housing and at least one controller comprising a microprocessor disposed in the housing. A removable cover is coupled to the housing wherein when this cover is removed the candles can be removed from the housing and then placed on an object such as a cake. In addition, there is a method for remotely controlling a candle comprising the steps of connecting at least one candle wirelessly with a base station, then controlling a lighting of a candle, then receiving a breath from a user. Next, the system can sense a humidity change in a humidity sensor based upon the breath placed on the sensor. Next, the humidity sensor transmits a signal to a microprocessor. Next, the system transmits a signal from the microprocessor to a remote candle to turn out the candle.

15 Claims, 16 Drawing Sheets

ELECTRONIC REMOTE CANDLE SYSTEM

CROSS REFERENCE TO RELATED APPLICATIONS

This application is a non-provisional application of provisional application Ser. No. 63/060,806 filed on Aug. 4, 2020, the disclosure of which is hereby incorporated by reference in its entirety.

BACKGROUND

One embodiment relates to a remote candle system. To keep those who celebrate birthdays and other events safe, it may be necessary to have a remote candle system which is configured to ignite or light a lighted candle at a distance from the candle when a remote receptacle is breathed on or blown on or actuated.

SUMMARY OF THE INVENTION

There is disclosed a remote-control candle kit comprising a housing a candle disposed in the housing and at least one controller comprising a microprocessor disposed in the housing. A removable cover is coupled to the housing wherein when this cover is removed the candles can be removed from the housing and then placed on an object such as a cake. In addition, there is a method for remotely controlling a candle comprising the steps of connecting at least one candle wirelessly with a base station, then controlling a lighting of a candle, then receiving a breath from a user. Next, the system can sense a humidity change in a humidity sensor based upon the breath placed on the sensor. Next, the humidity sensor transmits a signal to a microprocessor. Next, the system transmits a signal from the microprocessor to a remote candle to turn out the candle.

BRIEF DESCRIPTION OF THE DRAWINGS

Other objects and features of the present invention will become apparent from the following detailed description considered in connection with the accompanying drawings which disclose at least one embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
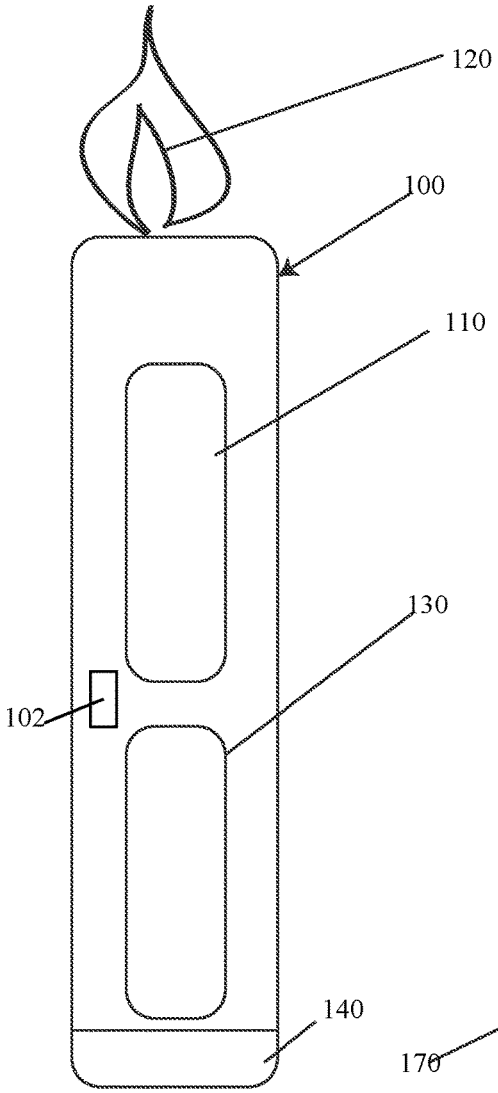
FIG. 1 is a first side cross sectional view of the candle.

Referring to the drawings, FIG. 1 shows a remote-controlled battery-operated candle system 99 including a remote-controlled candle 100 and a remote-control device 145. The candle 100 includes a plurality of batteries 110 and 130 as well as an on/off switch 102. There is an indicator light 120 which selectively illuminated when the device is remotely activated. The candle has an end cap 140 which allows for the selective insertion and removal of the batteries. The remote actuating device 145 includes a housing 170 which houses a first screen 150 and a sensor 160. There is also a bottom opening 180 which is configured to allow for the insertion and removal of batteries from the device. This device 145 is configured to communicate wirelessly via Bluetooth, RF, WIFI, GPRS, with location tracker GPS 315 (See FIG. 15) build in.

Figure 2:
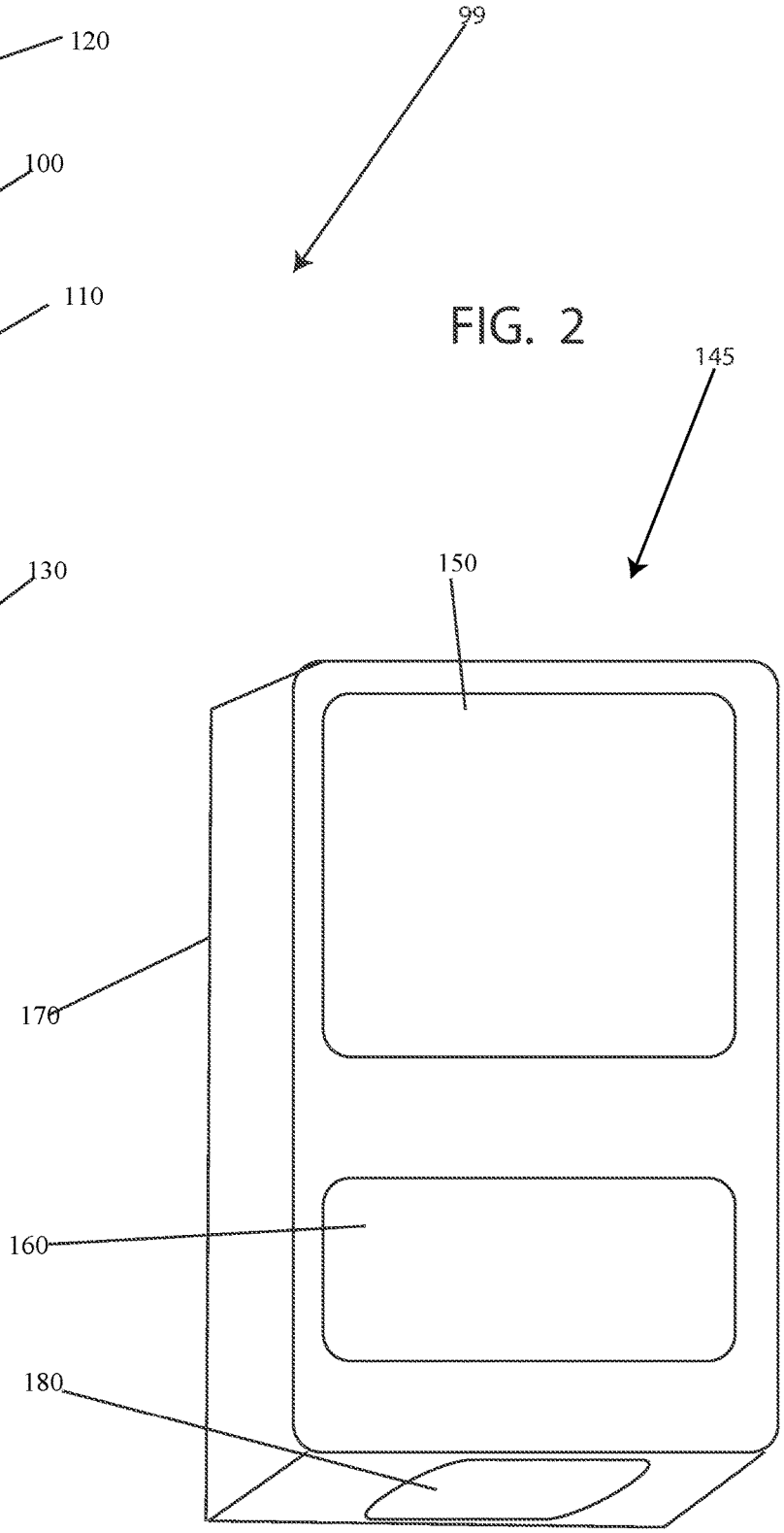
FIG. 2 is a perspective cross-sectional view of the remote control.
Figure 15:
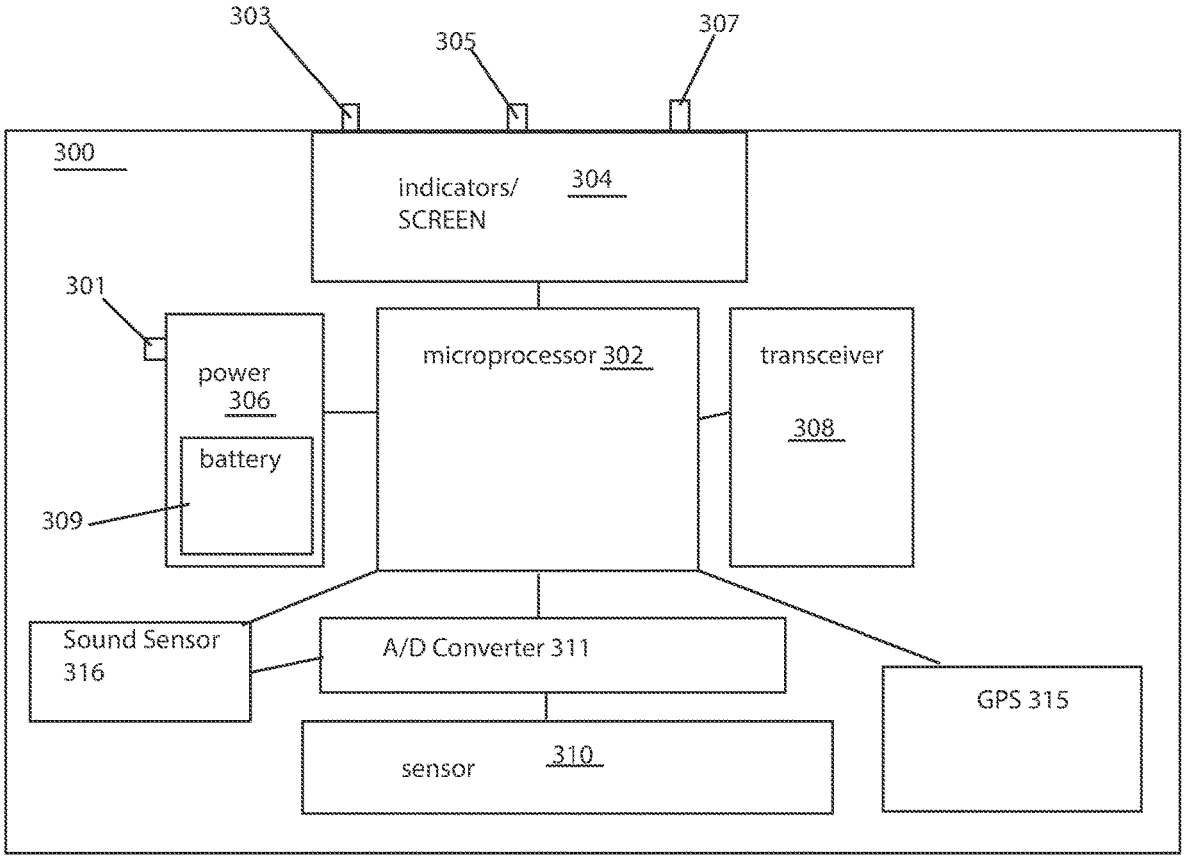
FIG. 15 is a view of a circuit layout.

As shown in FIG. 2 the device 145 comprises a body 170 having a screen 150 and a sensor 160, wherein sensor 160 will detect humidity and will react to it by electronically turning off to mimic a blowing of candles on a birthday cake or any food during celebrations. The main board for the electronics is shown in FIG. 15 which shows that the sensor is coupled to a processor which then sends a wireless signal to one or more remote candles to actuate these candles 100. The wireless signal 190 is shown passing between the main device 145 and the remote candles in both FIGS. 3 and 4.

Figure 4:
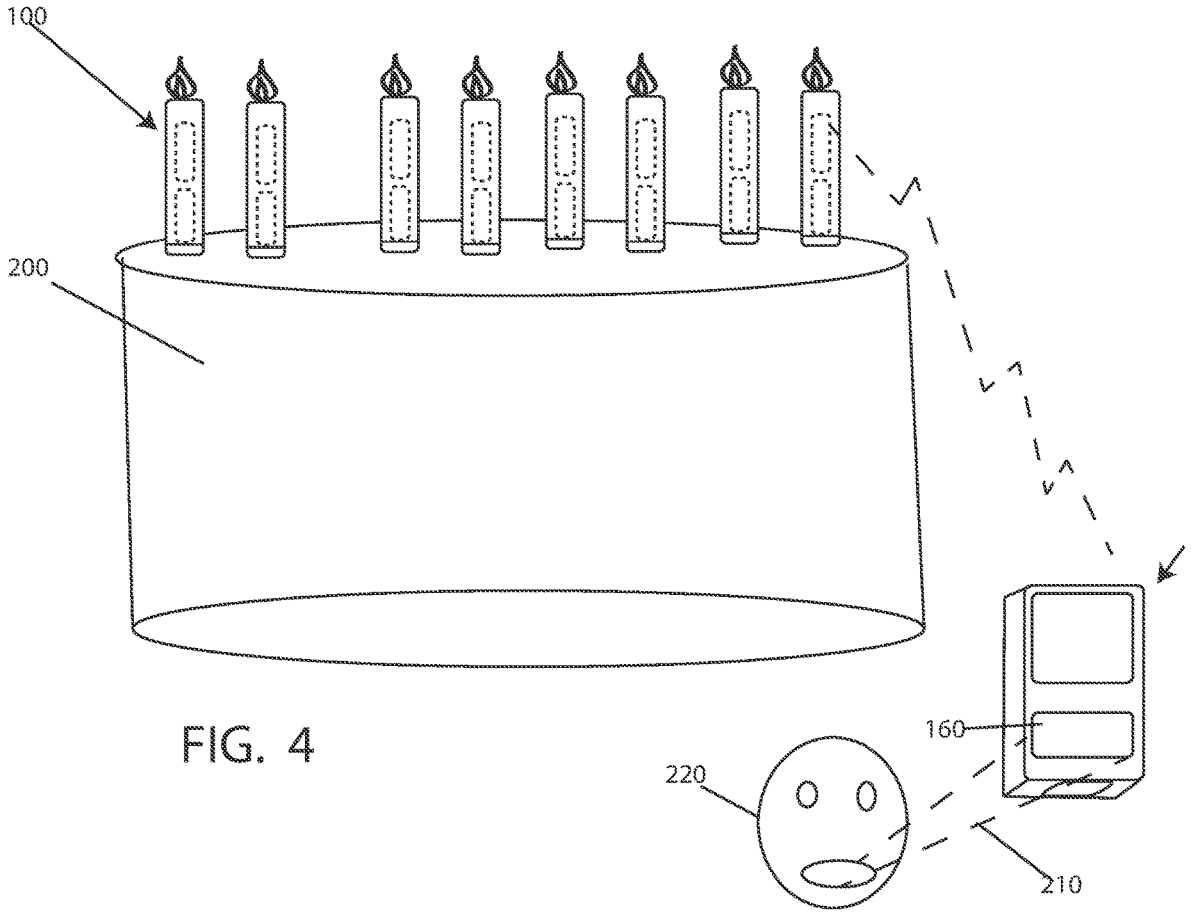
FIG. 4 is a side view of the remote control in communication with candles.

FIG. 4 shows a plurality of candies 100 disposed in a cake 200, wherein the wireless signal is selectively sent when a user 220 blows vapors 210 onto a sensor 160. The sensor 160 then detects the humidity in these vapors.

Figure 3:
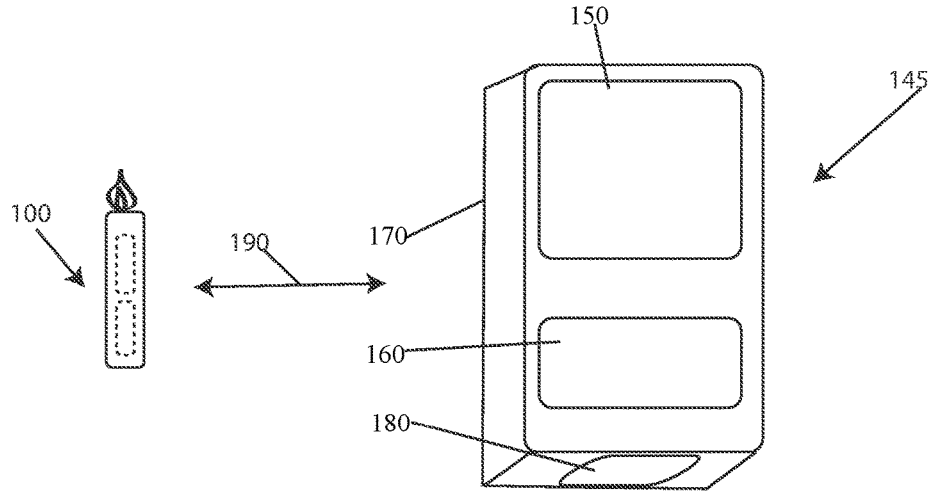
FIG. 3 is a side view of the candle in communication with the remote control.

The candle's LED light 120, see FIG. 1 will then turn off when the device 145 sends a signal to it (see signal 190 FIG. 3). The device 145 can also control the sequence of candles 100 to turn the LEDs 120 OFF and can control the color of the LED lights 120 on the remote candles 100. The candles 100 will be made with food safe grade plastic and are waterproof so the user will be able to wash it and reuse them. The interface screen 150 is either a touch screen, or with LCD screen.

To operate the system, the user will have to physically turn on via on/off button 102 (See FIG. 1) the candle 100 and then the candle 100 will automatically connect via wireless signal 190 to the transmitter module 145 when it's found.

The user then will choose the type of colors of the LED 120 of the Candle 100 via screen 150. After that, the pattern of the Candle 100 is to turn off after "blowing" into the sensor 160.

The pattern of shut down of each candle can be all at once, or one at a time, or randomly. The user can also choose the brightness of the LED light 120 of the candle 100 depending on the situation.

The candle 100 has an end cap 140 which allows for the different batteries to be changed out as necessary.

Figure 5:
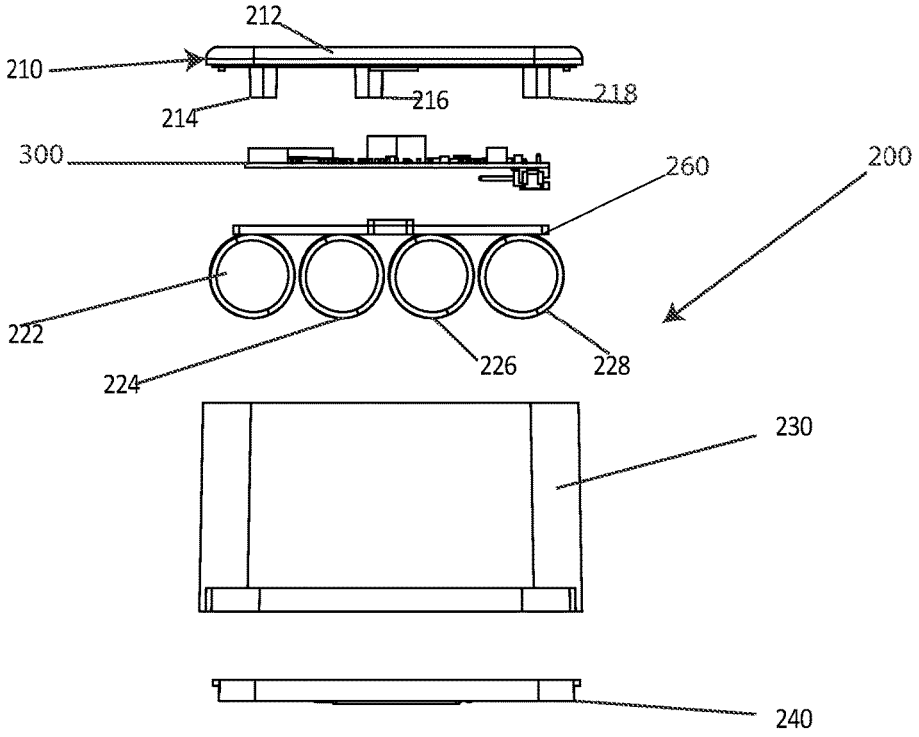
FIG. 5 is a side exploded view of the device which contains the candles.
Figure 6:
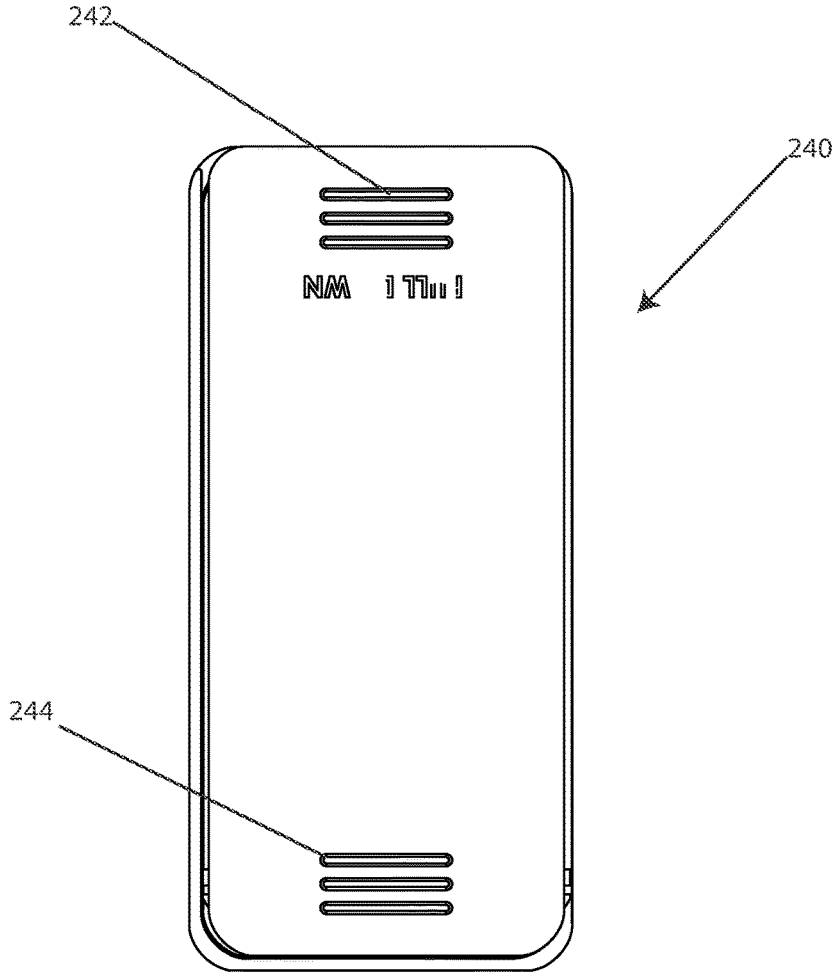
FIG. 6 is a back view of the device.

FIG. 5 is a top cross-sectional view of another embodiment of the device 200 which includes a housing 230 which is configured to house a circuit board 300 along with a series of candles 222, 224, 226 and 228 as well as two different covers 210 and 240. The housing 230 is configured to have sufficient depth so that the candles can be stored therein. Each side of the housing 230 has a cover 210 and 240. The cover 210 has a plurality of tabs 214, 216, and 218 with a body 212 therein. Each of the tabs 214, 216 and 218 is configured to hold the circuit board 300 therein. The other cover 240 is also configured to be coupled to the housing 230 as well. This cover 240 includes slots or vents 242 and 244 which allow air flow therein. The air flow which can flow therein is used for venting heat as well as allowing for air flow into a sensor such as sensor 310 that is stored inside.

Figure 7:
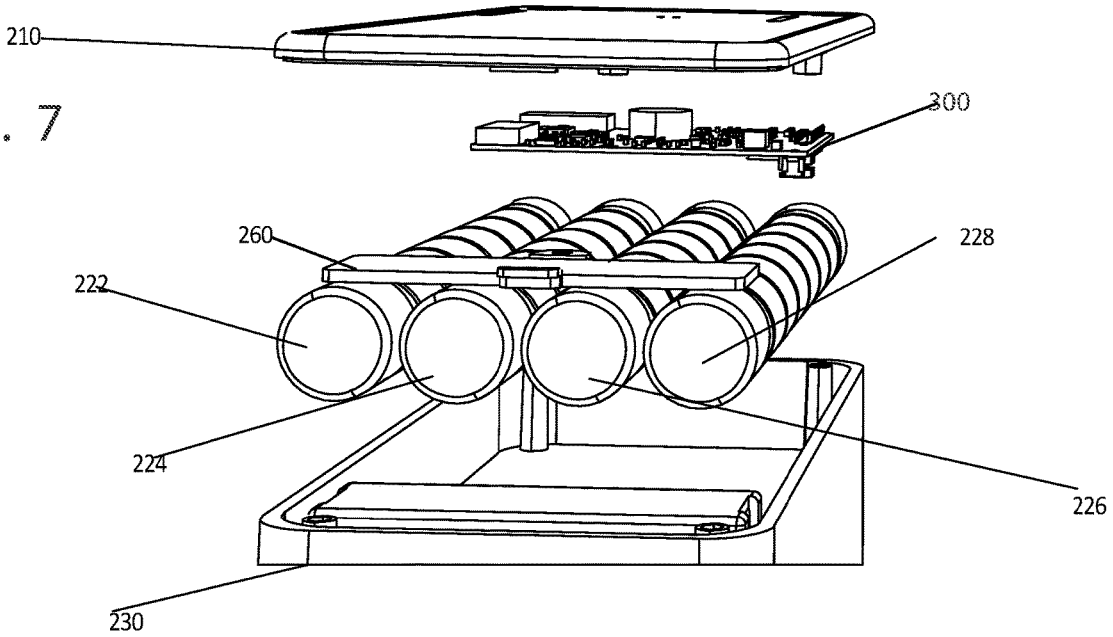
FIG. 7 is a perspective view of the device.
Figure 8:
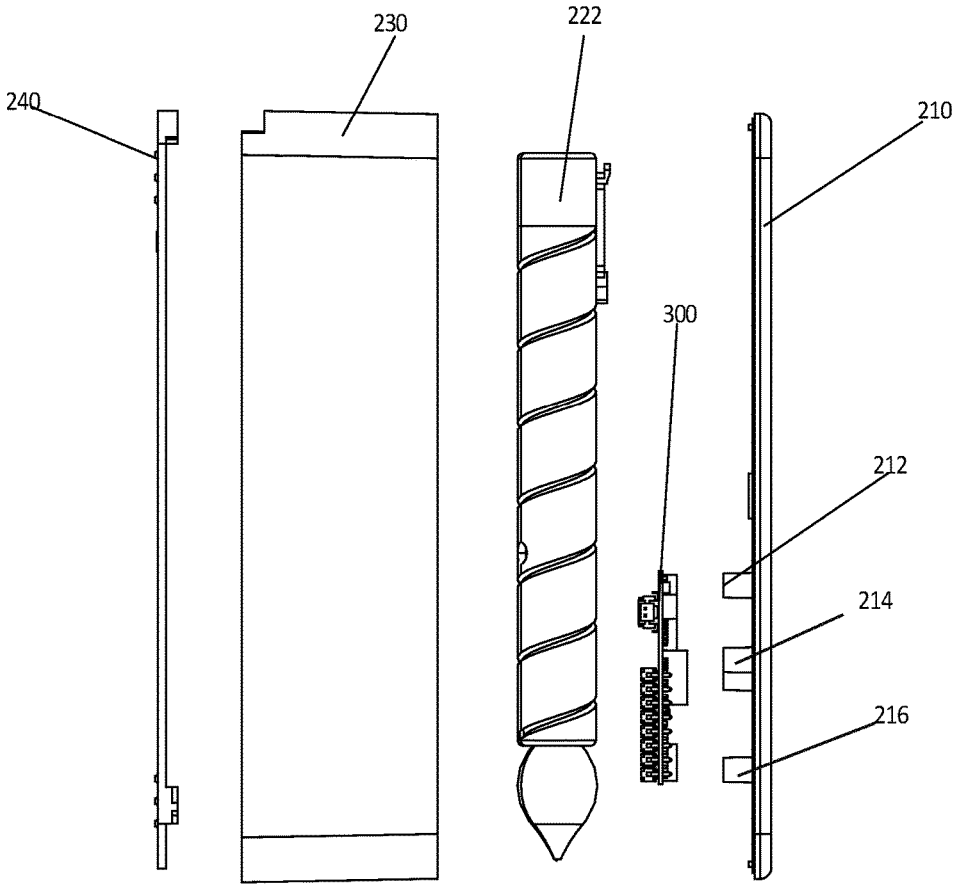
FIG. 8 is a side view of the device.

Sensor 310 can be in the form of a humidity sensor which is configured to pass a signal based upon an increased sense of humidity to a microprocessor to determine whether a user blew or breathed upon a controller. FIGS. 7 and 8 also show exploded views of these parts including housing 230, covers 210 and 240, as well as candles 222, 224, 226, and 228. Circuit board 300 is disposed inside the housing 230 adjacent to candles 222. As shown tabs 212, 214, and 216 are configured to hold circuit board 300.

Figure 9:
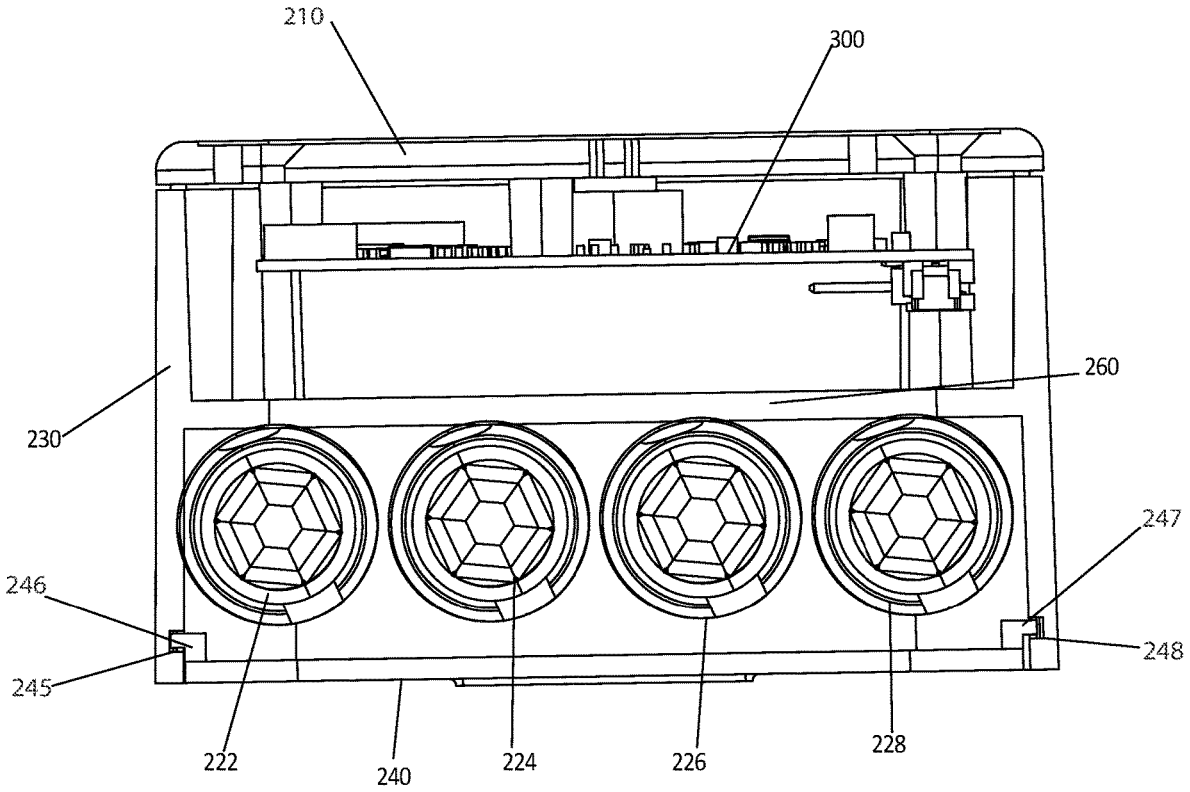
FIG. 9 is a cross-sectional view of the device.

FIG. 9 shows a cross-sectional view of the device which shows circuit board 300 disposed inside of housing 230. Candles 222, 224, 226 and 228 are disposed inside of this housing. In addition, there is locking plate 260 disposed inside of housing 230 which is configured to lock these candles in place. The two plates 210 and 240 are disposed opposite each other, wherein plate 240 is secured with L-shaped tongues 246 and 247 slotted to fit within grooves 245 and 248. The face of plate 210 is configured to house a screen and the opening for a sensor such as sensor 310 to receive a breath from a user. (See FIG. 15.)

Figure 10A:
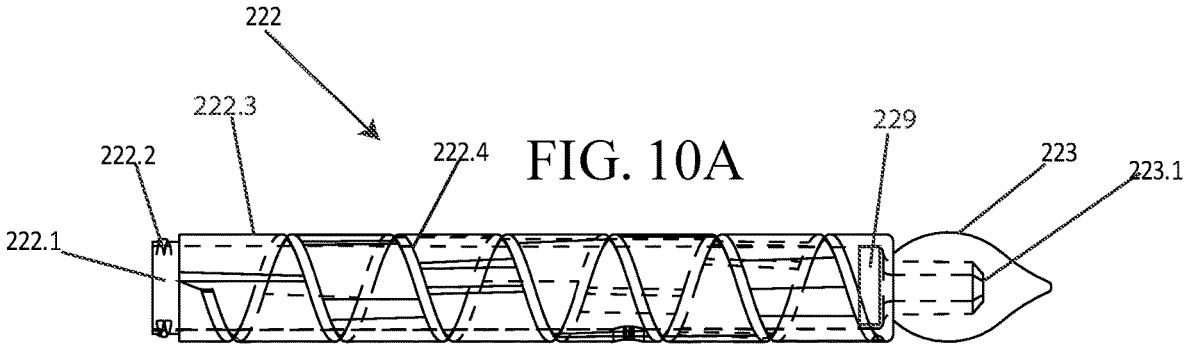
FIG. 10A is a side transparent view of a candle.
Figure 10B:
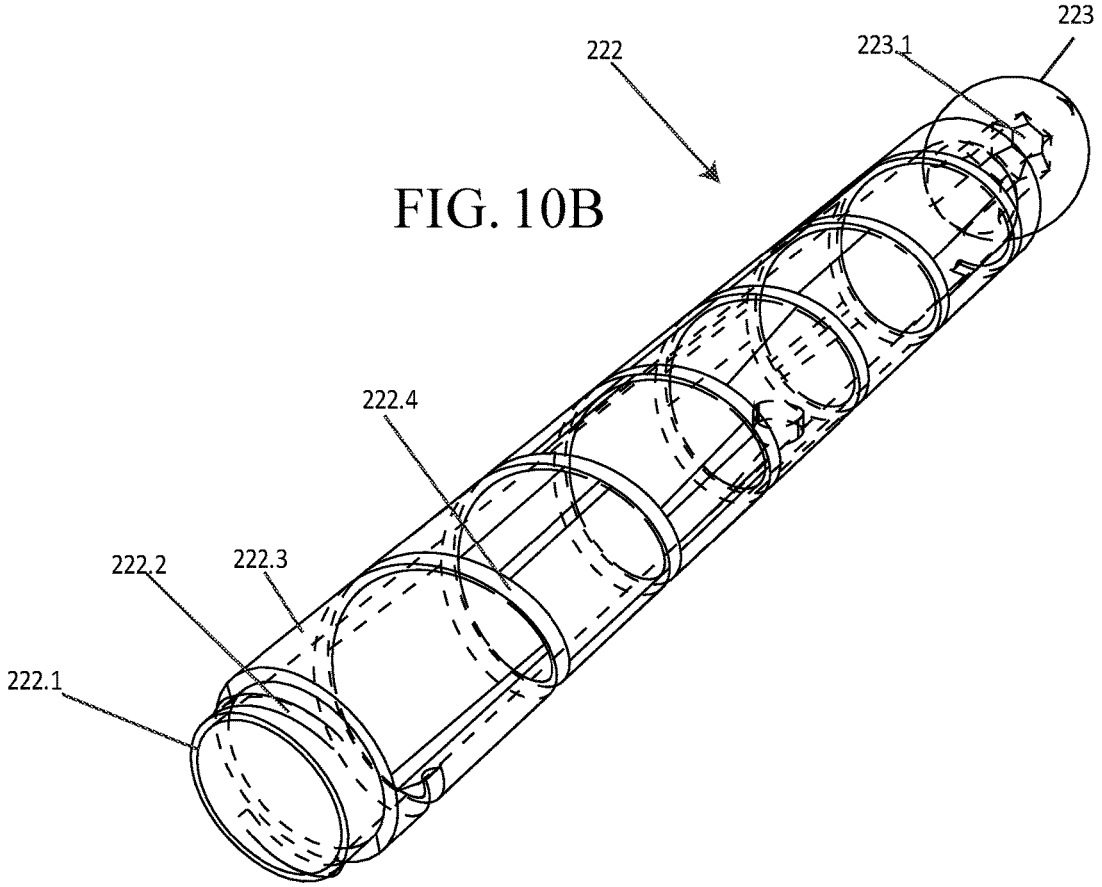
FIG. 10B is a perspective transparent view of a candle.
Figure 11A:
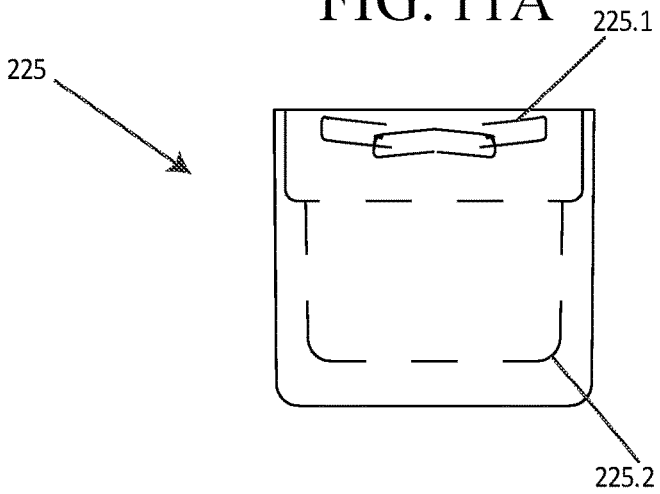
FIG. 11A is a side transparent view of an end piece.
Figure 11B:
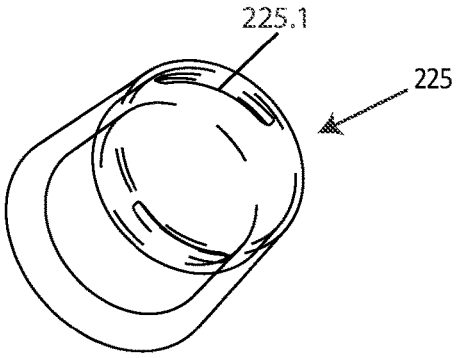
FIG. 11B is a perspective transparent view of an endpiece.
Figure 11C:
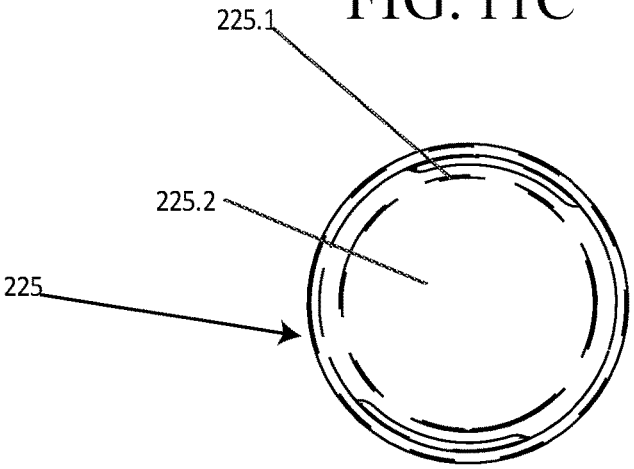
FIG. 11C is an end view of an end piece.
Figure 11D:
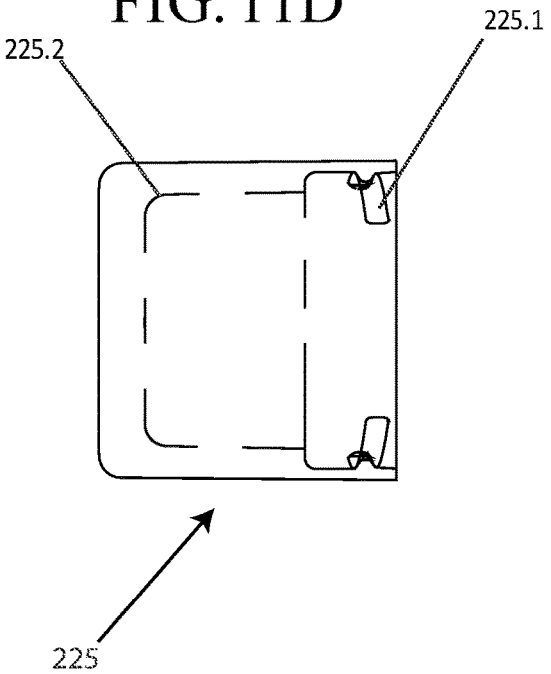
FIG. 11D is a side transparent view of an end piece.

FIG. 10A is a side view of a candle 222 which includes a candle body 222.3, having an end 222.1 having threads 222.2. There is a spiral 222.4 in candle body 222.3. At one end is the candle head 223 having a light disposed therein 223.1. FIG. 10B is a perspective view of this candle wherein the candle includes a body 222.3, and end 222.1, having a thread 222.2. A light 223 has a bulb 223.1 disposed therein. The body 222.3 is hollow and is configured to receive batteries such as one or two double AA batteries or one or two triple AAA batteries. Inside the body is a wireless transceiver 229 having an onboard microprocessor which is configured to communicate with the outside controller to selectively turn on or off the light or to selectively change the color of the light or to selectively flicker the light as well. One or more contacts disposed inside of candle body 222.3 is configured to provide power to the candlelight.

FIGS. 11A-11D show the end cap 225 which has an open basket section 225.2 and threads 225.1. This cap can be screwed onto the end of the body 222.1 onto threads 222.2.

Figure 12A:
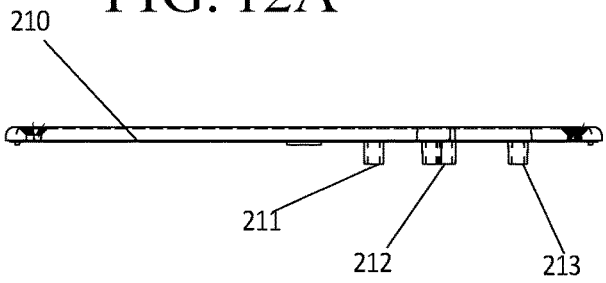
FIG. 12A is a side view of an end plate.
Figure 12B:
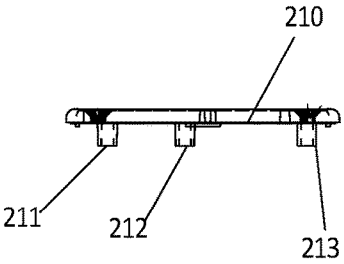
FIG. 12B is an end view of an end plate.
Figure 12C:
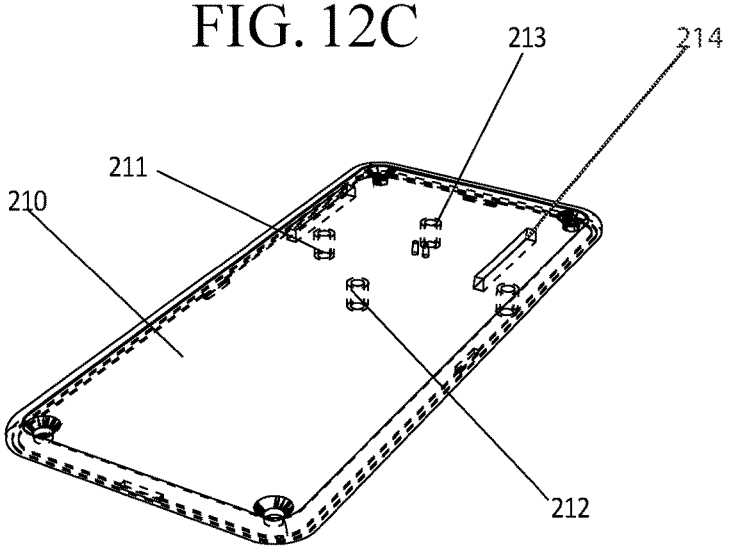
FIG. 12C is a perspective view of an end plate.

FIG. 12A is a side view of the backing or plate 210 which has tabs 211, 212 and 213 which are configured to be coupled to the circuit board 300. The backing has tabs 211, 212, and 213 which are configured to receive a circuit board 300. There is also a slot 214 which is configured to allow breaths through a slot to the circuit board which then gives access to sensor 310 for reading of the humidity of the breath.

Figure 13A:
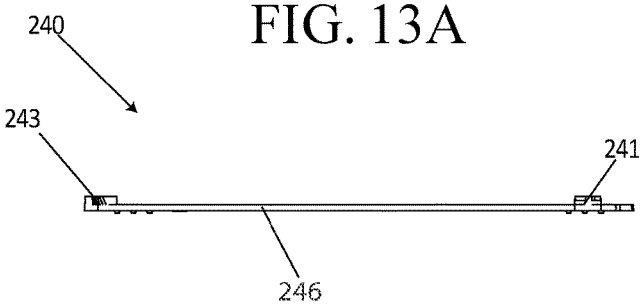
FIG. 13A is a side view of another end plate.
Figure 13B:
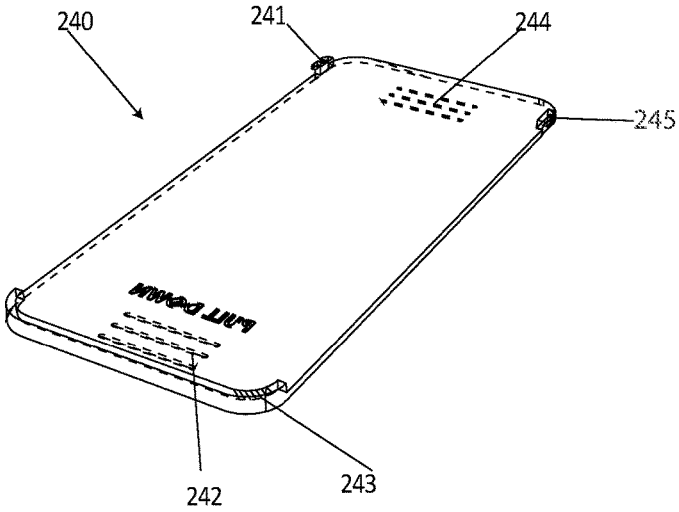
FIG. 13B is a perspective view of an end plate.
Figure 13C:
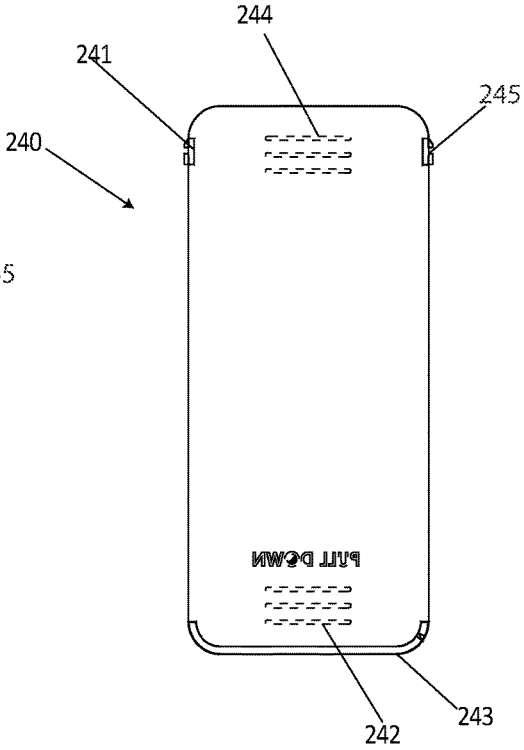
FIG. 13C is an end view of an end plate.

FIGS. 13A, 13B, and 13C show different views for the plate 240 which includes a rim 243, as well as tabs 241 and 245 coupled to a board 246. Slots 244 and 242 are open slots for venting of the interior of the housing. This housing is configured to slide in and out of housing 230 in a tongue and groove manner as shown in FIG. 9.

Figure 14A:
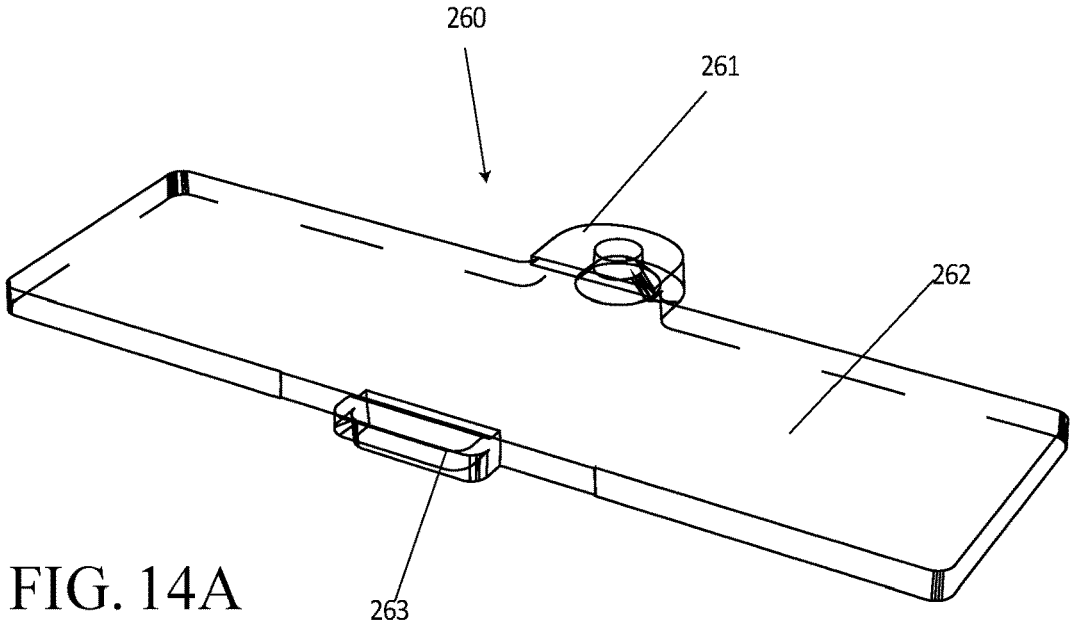
FIG. 14A is a perspective view of another plate.
Figure 14B:
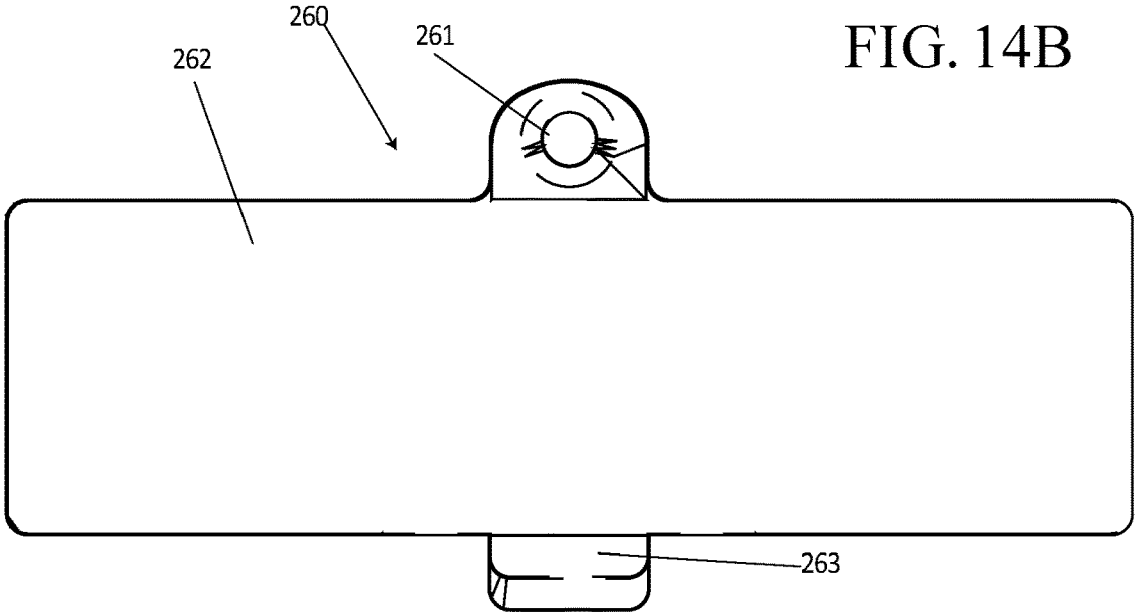
FIG. 14B is a side view of another plate.

FIGS. 14A and 14B show a plate 260 which sits inside of housing to lock the batteries inside of housing 230 so that they provide power to the components of housing 230 such as the circuit board 300.

FIG. 15 shows a layout of the electronic components disposed on the circuit board 300. The circuit board 300 houses microprocessor 302 which is coupled to a power station 306 having a button 301. Disposed within the power station 306 is a battery 309. These batteries can be stored inside of housing 230 as described above. Coupled or in communication with microprocessor 302 is an indicator screen 304 which can be a different screen or the same screen as screen 150 (See FIG. 2). A plurality of LED lights such as lights 303, 305 and 307 are also coupled to the motherboard and are configured to be selectively operated via microprocessor 302 to provide several different indicator lights such as a power light 303, an operating light 305 and an actuating light 307. Transceiver 308 is configured as a transceiver which will communicate information to the candles or other parties such as a cell phone. As described above transceiver 308 is configured to communicate over CDMA, WIFI, RF, GPRS, Bluetooth or any other type of communication protocol. In addition, coupled to microprocessor 302 is a GPS sensor/transceiver 315. This GPS sensor/transceiver is present to provide communication to GPS satellites to provide geolocation of the sensor if necessary. In addition; there is also a sensor 310 which is a humidity sensor which is coupled to an analog to digital converter 311 which is then fed into microprocessor 302. Ultimately the humidity sensor 310 is configured to receive a breath from a user who then with the humidity of his breath allows for a transmission into A/D converter the change in humidity which then signals to the microprocessor 302 to turn off the remote lights such as light 120 or light 223.1 (See FIG. 10A), There is also an optional sound sensor 16 which is configured to also act either in conjunction with the humidity sensor 310 or separately to activate (or shut off) the candles. The candles are ultimately in wireless communication with transceiver 308.

Figure 16:
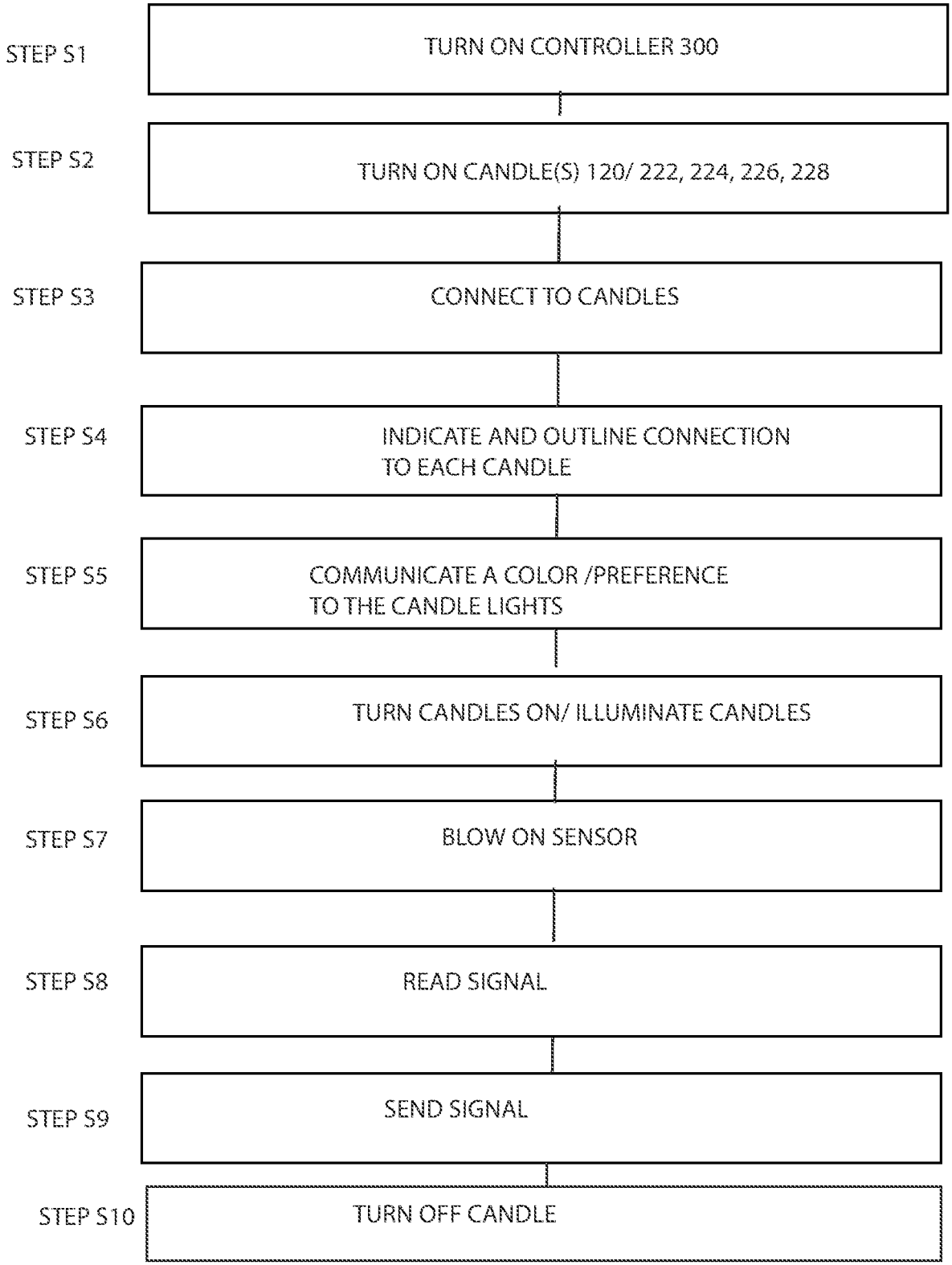
FIG. 16 is a view of a first flow chart.

The process for using this device is shown in FIG. 16 wherein the process starts in step S1 wherein the controller 300 is started by pressing the power button such as power button 301. Next, the user can take out the candles such as candles 120, 222, 224, 226, and 228. The user can in step S2 turn the candles 120, 222, 224, 226 and 228 on. Next in step S3 the user can connect the controller 300 to the candles 120, 222, 224, 226 and 228. Next, in step S4 the user can indicate and outline the connection to each candle. This means that the connection is registered on the screen such as screen 150 indicating which candle is connected and how it is connected. Next, in step S5 the system provides a menu on screen 150 to change the color of the light of the candle and/or communicate a shut down of the candle. The user can control the flickering of the candles, the duration of the blow out, the number of times the user must blow to blow out the candles, or the order of the candles. This process for customization is shown in greater detail in FIG. 17. Next, in step S6 the user can turn the candle lights on using the controller via screen 150. Now with the candles lit, the candles can be put in place for use such as in a cake. Next, in step S7, the user can blow on the sensor such as sensor 160 or sensor 310. Next, in step 38, the system can read a signal from sensor 160 or 310. Next, in step S9, the system after it processes the signal in step S8, it sends the signal in step S9. Next, in step S10 the system turns off the candle(s).

Figure 17:
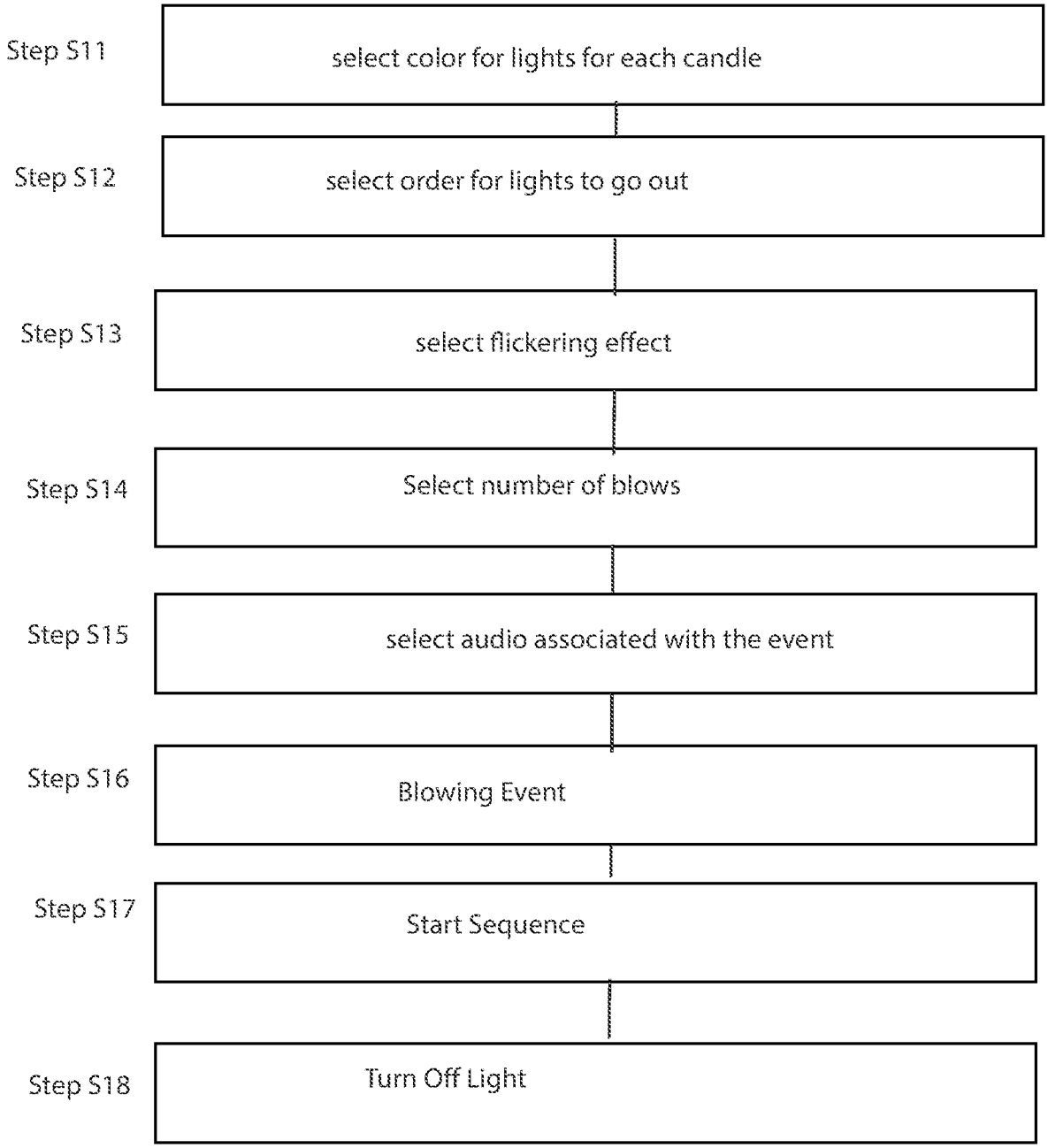
FIG. 17 is a view of another flow chart.

Step S5 is shown in greater detail in FIG. 17 wherein this process starts with step 311 wherein the user can select the color for the lights for each candle. In this way the user can control the color that is illuminated from the LED 120, 223.1 housed in the candle. Next, in step 312 the user can select on screen 150 the order for each of the lights to go out. For example, each light or candle can have an identity such as candle 1, candle 2, candle 3, and/or candle 4. The user can then select the order that each of these candles either flickers or goes out. Next, in step S13, the user can select the flickering effect. The flickering effect is whether the lights flicker, the order in which they flicker, whether one or more goes out on the first blow etc. Next, in step S14, the user can select the number of blows that are used by the person before blowing the candles out. Next, in step S15 the user can select the audio that is associated with the event.

Next, in step S16 the user can engage in a blowing event wherein the user blows on the sensor such as sensor 160 or 310. The rapid change in humidity results in a reading in the sensor which sends an analog signal into A/D converter 311 which then results in a start of the programmed sequence. Next, in step S17 the sequence is started wherein based upon the selections made above, the lights will change color, flicker, blow out or reignite. Eventually either after the first blow or after more than one blow, each candle is selectively turned off in step S18.

Figure 18A:
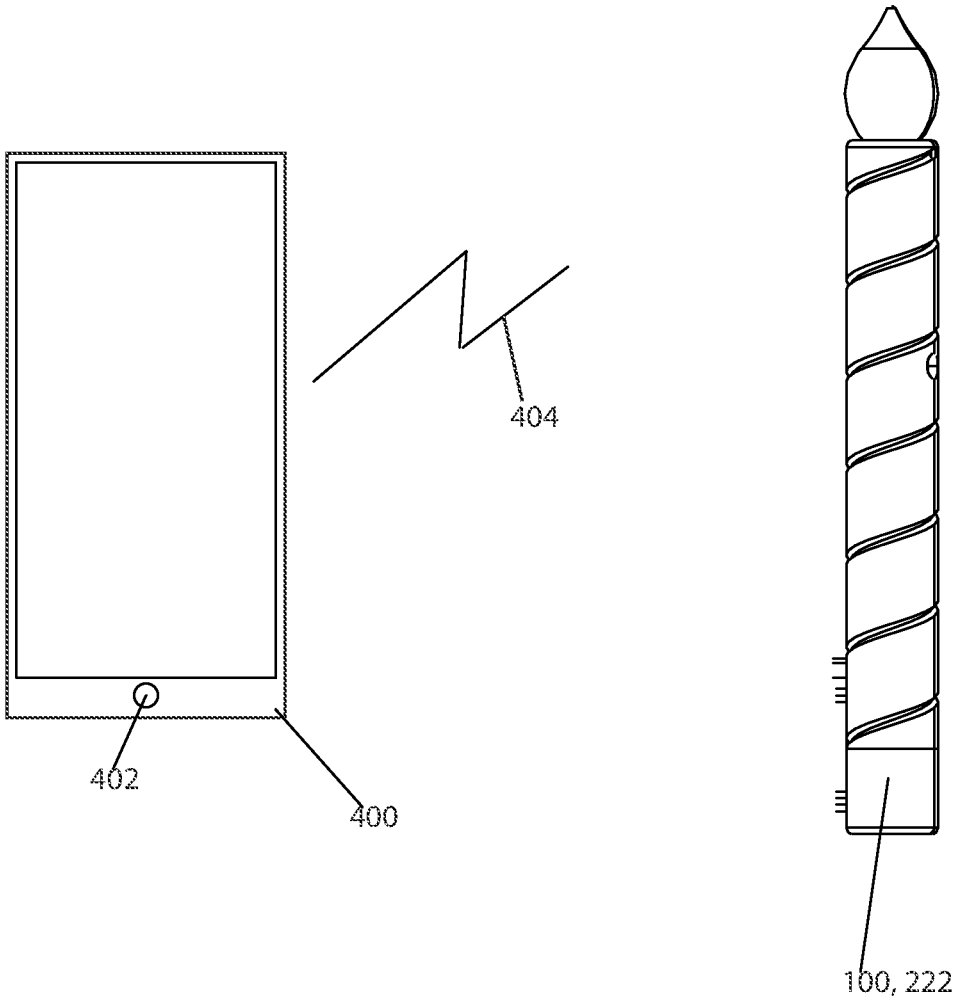
FIG. 18A is a view of another embodiment using a portable electronic device such as a phone for controlling candles.
Figure 18B:
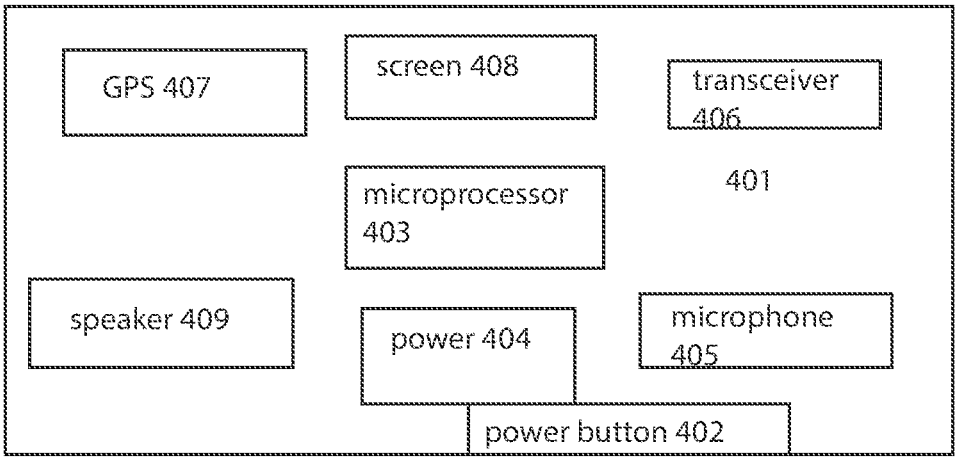
FIG. 18B is another embodiment which shows the electronic components of a phone or other electronic device for use with candles

FIG. 18A is a view of another embodiment using a portable electronic device such as a phone for controlling candles. For example, with this design instead of the electronic device 145 shown in FIG. 1 or the electronic device 200 shown in FIG. 5, there is a phone such as phone 400 which is in communication with candles such as a candle 100 or candle 222. Thus, a phone app can be used to control the remote candle. In this case, a user can open the app, and then the app is configured to connect to the candles. Once the app/phone as connected wirelessly with the candles, the phone can turn on the candles (illuminate the candles). Next, the user can select FIG. 18B is another embodiment which shows the electronic components of a phone or other electronic device for use with candles. This view shows that there is a motherboard 401, which has disposed on it a microprocessor 403. A power supply 404 is configured to power the motherboard 401. Power button 402 is configured to selectively turn on the phone 400. In addition, disposed on the motherboard and in communication with the microprocessor is a microphone 405, a transceiver 406. There is also a screen 408 as well as a GPS 407 in communication with microprocessor 403. A speaker 409 is also in communication with the microprocessor 403 as well. The microphone 405 is particularly important in this embodiment wherein the noise made from the user is configured to selectively turn off the candles in the even the user either blows on the phone and the microphone detects the sound of blowing or the user makes a voice command which is then translated into an indication to turn off the candles.

Thus, the process using this embodiment starts in step S20 wherein the user can turn on the electronic device such as a phone. Next, the user in step S21 can turn on the candles. Next, in step 322 the user can connect the phone 400 with the remote candles such as candle 100 or candle 222. With the opening of an app (application) on a phone the app is configured to instruct the phone to wirelessly (Bluetooth or WIFI or any other suitable wireless protocol) connect to each of the candles. Each of the candles is identified in the app. Next, in step S23 the user can illuminate the candles. These candles can be illuminated by sending a wireless instruction to the candles to illuminate the light associated with each of the candles. Each of the candles can receive a wireless signal to the wireless transceiver 229 inside the candle to selectively illuminate the candle. Next, the user can set the preference for the candles and their operation, the different steps for selection of these preferences are found in FIG. 17 steps 11-18. Next, in step S25 the user can blow or make noise to the phone or microphone so that it initiates a shutdown sequence in step S26.

Figure 19:
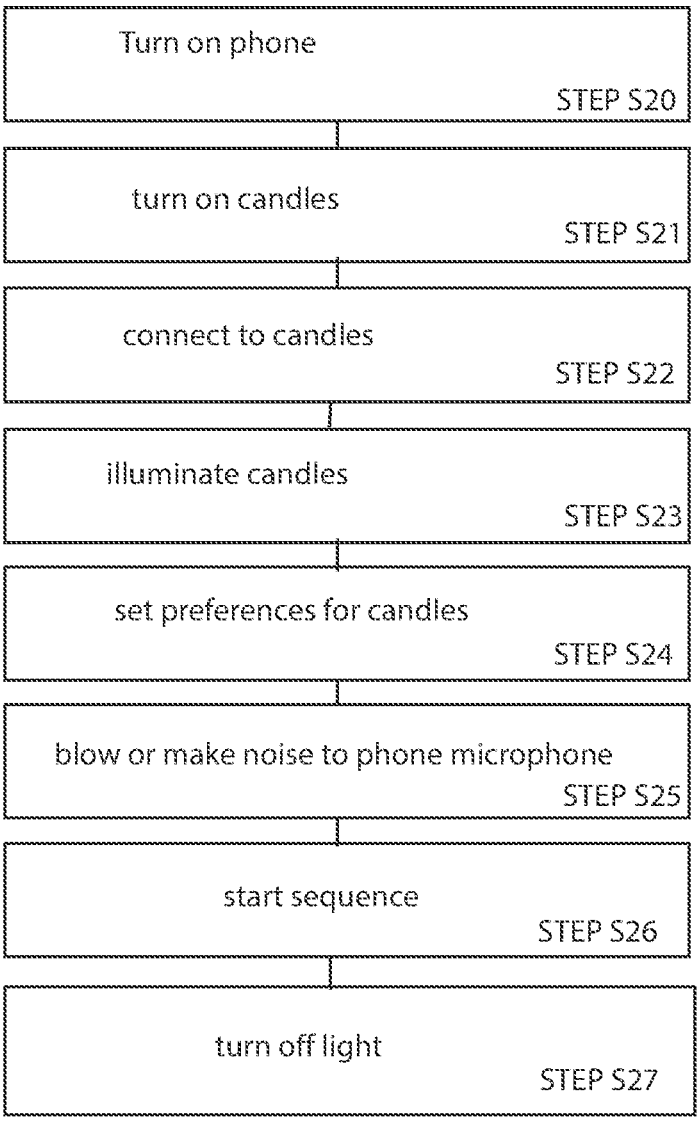
FIG. 19 is a flow chart for connecting to a remote candle using a phone.
Figure 20:
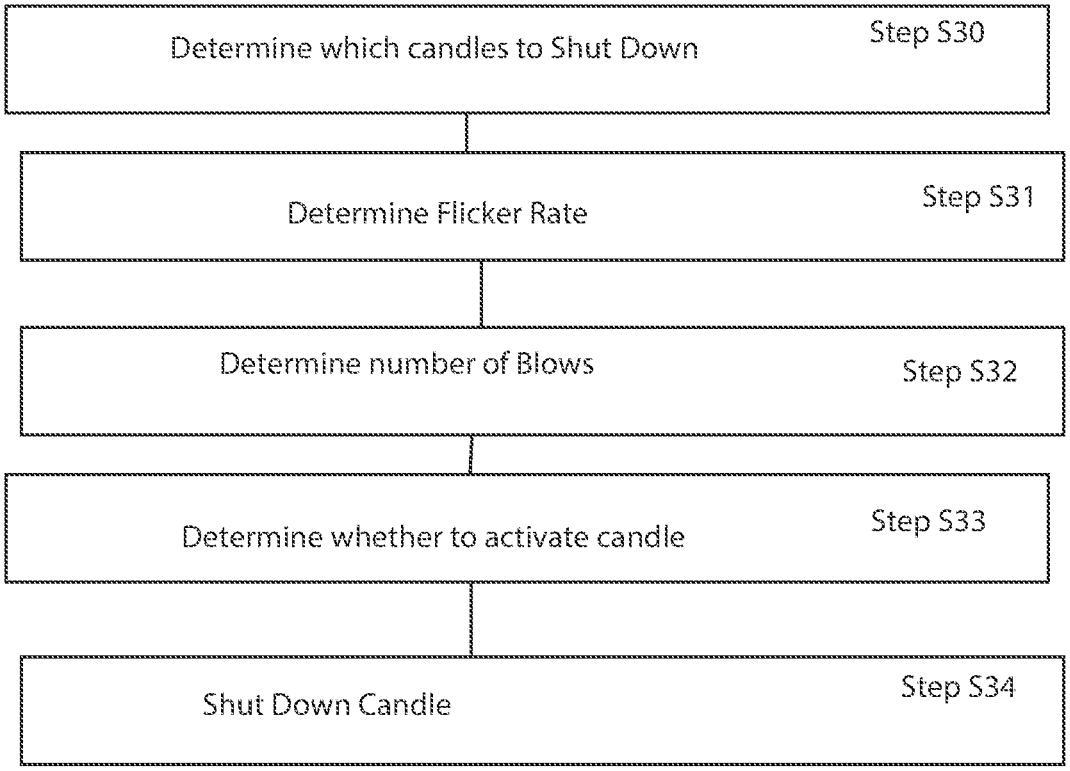
FIG. 20 is a flow chart for a shutdown sequence for a remote candle.

Once the user blows on the phone 400 this can initiate a shutdown sequence 26 (or step S10 shown in Fla 16) which is shown in greater detail in FIG. 20. For example, this sequence starts in step S30 wherein the system determines which candles to shut down. In this case this determination for the phone is done using processor 403 or done using processor 302 in the other device. Next, in step 331 the system determines the flicker rate of the candles as well. Next, in step 32 the system determines the number of blows that the user must perform before initiating a shut down. Next, in step S33 the system (microprocessor 403 or microprocessor 302) determines whether that indication (a blow or a touch of a button or movement on at touch screen) gives rise to a sufficient activity to activate the shutdown. This is determined as indicated above either through a change in humidity such as a detection of a 5% or greater level of humidity across a pre-set time period or via the sound of a blow or air or via the pressing of a button or region on a screen to give rise to a signal to activate a shutdown of a candle. Next in step S34, the system can then finally shut down the candle. This shut down sequence can be used in place of either Step S10 in FIG. 16 or steps S26 and 27 shown in FIG. 19.

Thus, there is created a simple remote controlled candle system when allows for the selection of different candles for use and for remotely controlling these candles so that they are selectively actuated and turned off via a user blowing into a controller.

Accordingly, while at least one embodiment of the present invention have been shown and described, it is to be understood that many changes and modifications may be made thereunto without departing from the spirit and scope of the invention as defined in the appended claims.

What is claimed is:

1. A remote control candle kit comprising:

a housing;

at least one candle disposed in the housing;

at least one controller disposed in the housing, the controller comprising at least one microprocessor;

at least one removable cover on the housing, wherein when the removable cover is removed from the housing it allows the candles to be removed from the housing so that these candles can then be placed on an object.

2. The remote-control candle kit as in claim 1, wherein each candle comprises at least one light.

3. The remote-control candle kit as in claim 1, wherein each candle comprises at least one light that is an LED light.

4. The remote-control candle kit as in claim 1, further comprising at least one screen coupled to the housing.

5. The remote-control candle kit as in claim 1, further comprising at least one sensor disposed in the housing.

6. The remote-control candle kit as in claim 5, wherein said at least one sensor is a humidity sensor configured to detect a change in humidity which can be caused by a user blowing on the sensor.

7. The remote-control candle kit as in claim 1, further comprising at least one transceiver, disposed in the housing wherein said at least one transceiver is a wireless transceiver.

8. The remote-control candle kit as in claim 7, wherein said at least one wireless transceiver is a Bluetooth transceiver.

9. The remote-control candle kit as in claim 7, wherein said at least one transceiver is a wireless transceiver.

10. The remote-control candle kit as in claim 1, wherein said kit further comprises a GPS transceiver for locating the kit via GPS.

11. A method for remotely controlling at least one candle comprising the steps of:

removing at least one removable cover which is on a housing, wherein when the removable cover is removed from the housing it allows the at least one candle to be removed from the housing so that the at least one candle can then be placed on an object;

removing the at least one candle from the housing;

connecting the at least one candle wirelessly with a base station;

controlling a lighting of the at least one candle;

receiving a breath from a user;

sensing a humidity change in a humidity sensor based upon the breath placed on the sensor;

transmitting a signal from the humidity sensor to a microprocessor;

transmitting a signal from the microprocessor to a remote at least one candle to turn out a light for the at least one candle;

turning out the at least one candle.

12. The method as in claim 11, further comprising the step of selecting a color for a light of at least one candle.

13. The method as in claim 11, further comprising the step of selecting an order for the lights to turn out when a user blows on the humidity sensor.

14. The method as in claim 11, further comprising the step of setting the flickering effect of the candles when they are blown out.

15. The method as in claim 11, further comprising selecting the number of blows that must be made before the candles are blown out.

* * * * *